US006034472A

United States Patent [19]

Oberndoerfer et al.

[11] Patent Number: 6,034,472

[45] Date of Patent: Mar. 7, 2000

[54] VACUUM TUBE HAVING A GETTER APPARATUS

[75] Inventors: Klaus Oberndoerfer; Roman Renz; Klaus Gessner, all of Berlin, Germany

[73] Assignee: Siemens Aktiengesellschaft, Munich, Germany

[21] Appl. No.: 09/031,293

[22] Filed: Feb. 26, 1998

[30] Foreign Application Priority Data

Feb. 28, 1997 [DE] Germany ..... 297 04 327 U

[51] Int. Cl.[7] ..... H01J 21/00; H01H 33/66

[52] U.S. Cl. ..... 313/495; 313/553; 313/558; 361/120

[58] Field of Search ..... 313/495, 553, 313/558, 559, 603, 352, 242; 361/120, 435

[56] References Cited

U.S. PATENT DOCUMENTS

| | | | |
|---|---|---|---|
| 3,474,282 | 10/1969 | Katz et al. | 313/553 X |
| 3,725,219 | 4/1973 | Wesoloski | 313/553 X |
| 5,866,978 | 2/1999 | Jones et al. | 313/553 X |

FOREIGN PATENT DOCUMENTS

| | | |
|---|---|---|
| 19 10 633 | 10/1969 | Germany . |
| 29 48 310 | 6/1980 | Germany . |
| 38 29 888 | 7/1993 | Germany . |
| 23 50 489 | 5/1994 | Germany . |

*Primary Examiner*—Ashok Patel
*Attorney, Agent, or Firm*—Kenyon & Kenyon

[57] ABSTRACT

A vacuum tube including a getter apparatus is provided. The getter apparatus includes a sheet-like support with an applied getter layer which is used to maintain vacuum in the vacuum tube during operation. The support has the shape of a strip, and is positioned in a groove of a shield or a contact pin of the vacuum tube. The support is immobilized using impressions of the groove rim.

4 Claims, 1 Drawing Sheet

VACUUM TUBE HAVING A GETTER APPARATUS

FIELD OF THE INVENTION

The present invention relates to vacuum electronic components. In particular, the present invention relates to a vacuum tube in which a getter apparatus is arranged inside a housing.

BACKGROUND INFORMATION

In a conventional vacuum tube having a stationary and an axially movable contact, and a housing surrounding the contact region, a getter apparatus is usually arranged inside the housing. This getter apparatus serves to absorb gases which are produced during operation of the vacuum tube, and may degrade the quality of the vacuum. Conventional getter apparatuses have a support made of a sheet-metal strip on which the getter material, such as zirconium-aluminum or zirconium-titanium, is applied, and which is attached to a metal structural part of the vacuum tube, for example to the main screen or to an end flange. Usually, one or more getter fields are arranged on a strip-shaped substrate made of nickel, and this substrate is attached to a screen or an end flange of the vacuum tube by spot welding.

As described in, for example, German Patent Nos. DE 23 50 489 A1 and DE 29 48 310 A1, a heatable getter apparatus may also be configured in an annular fashion. The getter apparatus may be arranged concentrically with respect to the stationary contact pin of the vacuum tube.

SUMMARY OF THE INVENTION

It is an object of the present invention to configure the attachment of a getter apparatus to the metal part in such a way that it is independent of the material combination used for the metal part of the vacuum tube and the getter body support.

To achieve this object, provision is made, according to the present invention, for the metal part carrying the getter apparatus to be equipped with a flat annular groove; and for the groove width to correspond to the width of the strip-shaped sheet-metal part. The sheet-metal part is positioned into the groove and is immobilized by impressions of the groove rim.

In certain vacuum tubes, materials (in particular copper) that are not weldable to nickel or to iron alloys are used for screens and end flanges. Thus, the conventional attachment technique for the getter apparatus would not be usable for such vacuum tubes. The present invention, however, may be applied to a vacuum tube in which not only the contact pin, but also the main screen and/or the end flange are made of copper.

The present invention may also be applied to vacuum tubes in which the surface area available on the end flanges for arrangement of a getter apparatus is too small. Additionally, the present invention may be applied to conventional vacuum tubes having a screen or end flanges made of CrNi steel or an FeNiCo alloy.

In accordance with the present invention, in vacuum tubes having a thick-walled screen made of copper or a copper alloy, a flat annular groove may be recessed into the outer surface of the screen. This may also be done with contact pins whose diameter is sufficiently large not to cause excessive bending of the getter apparatus. In the case of contact pins with a smaller diameter, a groove in the longitudinal direction may be considered. A further advantage of the present invention is that the attachment is accomplished purely mechanically, i.e. by slight deformation of the groove rim at certain points.

DETAILED DESCRIPTION OF THE INVENTION

Figure 1:
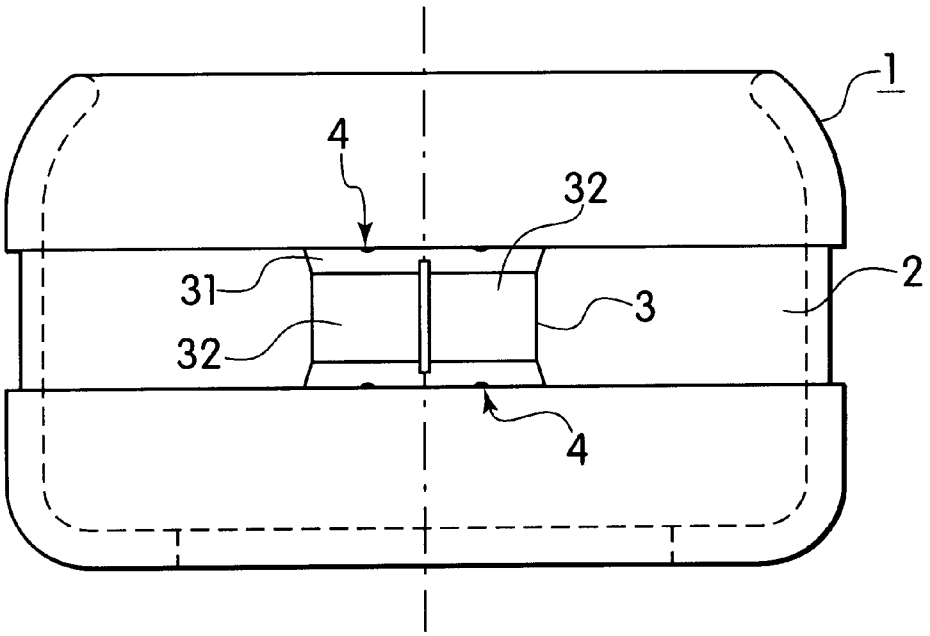
FIG. 1 illustrates a screen portion of a vacuum tube carrying a getter apparatus in accordance with one exemplary embodiment of the present invention.
Figure 2:
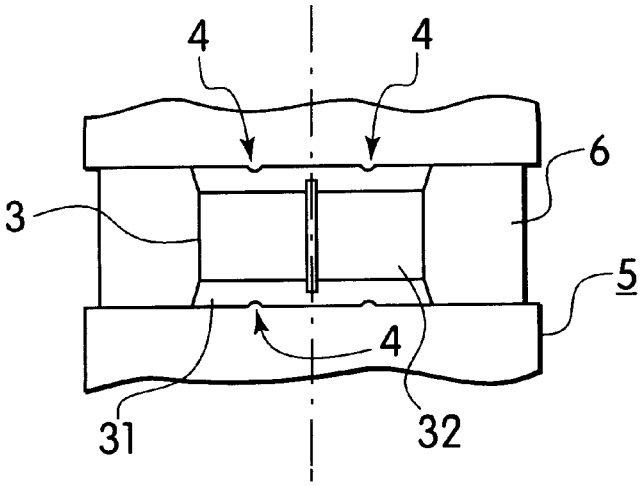
FIG. 2 illustrates a contact pin of a vacuum tube carrying a getter apparatus in accordance with a second exemplary embodiment of the present invention.

Two exemplary embodiments of the invention are depicted in FIGS. 1 and 2. Since the physical structure of a vacuum tube is well known, only the metal part carrying the getter apparatus in accordance with the present invention (i.e., a screen in FIG. 1, and a contact pin in FIG. 2) is depicted.

FIG. 1 shows a view of a cap-like shielding body 1 which is the main screen of a small vacuum tube. Main screen 1 is made of copper and has a wall thickness of approximately 2 mm. Recessed into the outer surface of the main screen 1 is a flat annular groove 2 with a depth of approximately 0.8 mm. Set into this groove is getter apparatus 3, which consists of a strip-like sheet-metal part 31 as support, and the two fields 32 of getter material. The width of sheet-metal strip 31 corresponds to the width of groove 2. For immobilization of the sheet-metal strip, the groove rim is deformed by small impressions 4 by means of which sheet-metal strip is non-displaceably immobilized.

FIG. 2 shows a view of a longitudinal section of a contact pin 5 which is also equipped with a circumferential flat annular groove 6. In the flat annular groove 6, getter apparatus 3, which also consists of a sheet-metal strip 31 and the two getter fields 32, is immobilized by impressions 4 in the same way as with the exemplary embodiment shown in FIG. 1. This manner of attaching the getter apparatus may be considered in particular for larger vacuum tubes, in which the diameter of the contact pin is at least approximately 25 mm. For contact pins with a smaller diameter, the getter apparatus may be attached in a groove which extends in the axial direction over a limited longitudinal section of the contact pin.

What is claimed is:

1. A vacuum tube including a housing, comprising:

a first metal part positioned within the housing and having a flat groove, the flat groove including a rim, the rim having at least one impression, and the flat groove having a first width; and a getter apparatus, arranged inside the housing, the getter apparatus including a strip-shaped sheet-metal part coupled to the first metal part and being coated with a getter material, the strip-shaped sheet-metal part having a second width, the first width corresponding to the second width, the strip-shaped sheet-metal part being positioned in the flat groove and immobilized by the at least one impression.

2. The vacuum tube according to claim 1, wherein the first metal part includes a shield having an outer surface, the flat groove being recessed into the outer surface.

3. The vacuum tube according to claim 1, wherein the first metal part is a contact pin, the contact pin including the flat groove, the flat groove extending in one of a circumferential direction and an axial direction.

4. The vacuum tube according to claim 1, wherein the first metal part is made of copper.

* * * * *